US007516642B2

(12) United States Patent
Seethaler et al.

(10) Patent No.: US 7,516,642 B2
(45) Date of Patent: Apr. 14, 2009

(54) METHOD FOR CALIBRATION OF A SENSOR ON A ROTATIONAL ACTUATOR DEVICE FOR CONTROL OF A GAS EXCHANGE VALVE IN AN INTERNAL COMBUSTION ENGINE

(75) Inventors: Rudolf Seethaler, Munich (DE); Martin Lamprecht, Muehldorf (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/798,306

(22) Filed: May 11, 2007

(65) Prior Publication Data

US 2007/0208488 A1 Sep. 6, 2007

Related U.S. Application Data

(63) Continuation of application No. PCT/EP2005/011247, filed on Oct. 19, 2005.

(30) Foreign Application Priority Data

Nov. 12, 2004 (DE) ..... 10 2004 054 776

(51) Int. Cl.
*G01B 21/16* (2006.01)

(52) U.S. Cl. ..... 73/1.79

(58) Field of Classification Search ..... 73/1.79; 123/90.16–90.23

See application file for complete search history.

(56) References Cited

U.S. PATENT DOCUMENTS 6,321,700 B1 * 11/2001 Hein et al. ..... 123/90.11
6,469,500 B1 10/2002 Schmitz et al.
7,055,475 B2 6/2006 Denteler et al.
7,111,598 B2 9/2006 Gaubatz et al.
7,380,433 B2 * 6/2008 Seethaler et al. ..... 73/1.79
2004/0221824 A1 11/2004 Denteler et al.
2006/0016408 A1 1/2006 Gaubatz et al.

FOREIGN PATENT DOCUMENTS

DE 102 20 199 A1 12/2002
DE 101 40 461 A1 2/2003
DE 102 52 991 A1 5/2004

OTHER PUBLICATIONS

International Search Report dated Feb. 22, 2006 with English translation (Four (4) Pages).
German Search Report dated Aug. 2, 2005 with English translation (Four (4) Pages).

* cited by examiner

*Primary Examiner*—Hezron Williams
*Assistant Examiner*—Nashmiya S Fayyaz
(74) *Attorney, Agent, or Firm*—Crowell & Moring LLP

(57) ABSTRACT

A method for calibrating a distance sensor of a rotary actuator device for controlling a valve of an internal combustion engine. The rotary actuator includes an electric motor with an actuator element for actuating the valve, two energy storage means acting on the valve in opposite drive directions, and a control unit for controlling the electric motor. The electric motor is controlled such that the valve is transferred from a first end position, in which the actuator element is a metastable torque-neutral position, to a second metastable torque-neutral position. Starting from a torque-neutral position, the electric motor is controlled such that the rotor is moved out of the torque-neutral position in at least one direction by a distance, and the resulting electric motor power consumption is measured. Depending on the electric motor current values, a new rotor position for calibration of the distance signal is ascertained.

3 Claims, 2 Drawing Sheets

METHOD FOR CALIBRATION OF A SENSOR ON A ROTATIONAL ACTUATOR DEVICE FOR CONTROL OF A GAS EXCHANGE VALVE IN AN INTERNAL COMBUSTION ENGINE

This application is a Continuation of PCT/EP2005/011247, filed Oct. 19, 2005, and claims the priority of DE 10 2004 054 776.9, filed Nov. 12, 2004, the disclosures of which are expressly incorporated by reference herein.

BACKGROUND AND SUMMARY OF THE INVENTION

The present invention relates to a method for calibrating a distance sensor of a rotary actuator device for controlling a charge cycle valve of an internal combustion engine.

In traditional internal combustion engines, the camshaft for controlling the charge cycle valves is driven mechanically by the crankshaft via a control chain or a control belt. To increase engine power and reduce fuel consumption, considerable advantages are achieved by controlling the valves of the individual cylinders individually. This is possible for a so-called fully variable valve drive (variable control times and variable valve lift), e.g., a so-called electromagnetic valve drive. With a fully variable valve drive, an "actuator unit" is allocated to each valve and/or each "valve group." At the present time, different basic types of actuator units are being researched.

With one basic type (so-called lift actuators) an opening magnet and a closing magnet are allocated to a valve or a valve group. By applying electric power to the magnets, the valves can be displaced axially, i.e., opened and/or closed.

With the other basic type (so-called rotary actuator) a camshaft is provided with cams whereby the control shaft is pivotable back and forth by an electric motor.

To regulate a rotary actuator, extremely accurate sensor values are required, providing information about the instantaneous position of the rotary drive element and/or the element driving the drive element of the rotary actuator itself, e.g., the position of the actuator element driven by the rotor or the rotor position itself. In known rotary actuator devices, distance sensors are calibrated by the approach to mechanical stops, which define the end positions of a control cam.

German Patent Document DE 101 40 461 A1 describes a rotary actuator device for controlling the lift of a charge cycle valve with such mechanical stops. The lift control of the charge cycle valves is accomplished here by an electric motor which is itself controlled by characteristics maps and which has a shaft with a control cam connected to it in a rotationally fixed manner arranged on the rotor of the electric motor. During operation of the internal combustion engine, the engine swings, i.e., oscillates back and forth, and the control cam periodically forces the charge cycle valve into its open position a pivot lever. The charge cycle valve is closed by the spring force of a valve spring. In order for the electric motor not to have to overcome the entire spring force of the valve spring when opening the charge cycle valve, an additional spring is mounted on the shaft. The forces of the valve spring and additional springs are such that in periodic operation of the rotary actuator device, the kinetic energy is either stored in the valve spring (closing spring) or in the additional spring (opening spring) in accordance with the position of the charge cycle valve. The invention is directed to unambiguously positioning the control cam by a first rotary stop and a second rotary stop for unambiguous positioning of the control cam in its end positions. However, one disadvantage of this arrangement is that the calibration of distance sensors for determining the position by approach to mechanical stops does not have a satisfactory precision for all applications. Depending on the design of the rotary actuator device used, the mechanical tolerances of the systems are so great that the required accuracy cannot be achieved.

An object of this invention is to provide a method for calibrating a distance sensor for a rotary actuator device to ensure more accurate positioning and/or determination of the position of the actuator element (and thus also the gas exchange value).

In a first especially preferred embodiment of the invention, starting from a metastable end position of the actuator element (here: camshaft) and/or starting from a metastable end position of the rotor of the electric motor, the electric motor is controlled in such a way that the rotor is moved out of its torque-neutral position by a distance in at least one direction and the resulting power consumption is determined. Then, depending on the power consumption thus determined, the distance sensor is coordinated (calibrated) with a new, optionally corrected, torque-neutral position (which in the ideal case may be the same as the old position or deviating only slightly from it) to determine the rotor position or the position of the actuator element.

In a preferred refinement of the invention, the rotor is deflected on both sides starting from a metastable torque-neutral position, the power consumption by the electric motor is observed and, as a function thereof, the distance sensor is calibrated to a corrected position, in particular a corrected metastable torque-neutral position. By slowly moving the rotor close to the metastable torque-neutral end position of the full stroke, the actual torque-zero position can be determined from the resulting electric power values (in proportion to the restoring torque acting on the rotor on the basis of the deflected opening or closing spring).

According to a second embodiment of the invention, the charge cycle valve is intentionally moved into a torque-neutral center position which in turn forms an unambiguous reference point for the calibration of the distance sensor. This torque-neutral central position is a stable position (so-called decayed or fallen position of the rotor) from which the rotor cannot be moved by a minimal pulse-type thrust energy in contrast with the metastable end positions at full lift described above. The rotor can be moved out of this stable position by a targeted startup or ramp up back into a partial or full lift operation. This position corresponds to the position when the rotor slips out of a metastable end position in an uncontrolled manner at full lift, which is not desirable during normal operation. In particular at startup of a motor vehicle, however, enough time is available to perform a calibration on the basis of this procedure and then ramp up the rotor again back to a normal operating position.

Other objects, advantages and novel features of the present invention will become apparent from the following detailed description of the invention when considered in conjunction with the accompanying drawings

BRIEF DESCRIPTION OF THE DRAWINGS

FIG. 1 shows a schematic diagram of a rotary actuator device for the drive of a gas exchange valve 2 of an internal combustion engine (not shown). The essential components of this device include an electric motor 4 (drive mechanism) designed in particular as a servomotor, a camshaft 6 (actuator element) driven by the electric motor, preferably having two cams 6*a*, 6*b* of different lifts, the camshaft connected to the rotor shaft in a rotationally fixed manner, a drag lever 8 (transfer element) which is in operative connection to the camshaft 6 on the one hand and to the charge cycle valve 2 on the other hand, for transferring the motion of the lift height, which is predetermined by the cams 6*a*, 6*b*, to the charge cycle valve 2, and a first energy storage means 10, which is designed as a closing spring and acts on the charge cycle valve 2 with a spring force in the closing direction and a second energy storage means 12, which is designed as an opening spring and acts upon the charge cycle valve 2 with an opening force via the camshaft 6 and a roller lever 8. Reference is made to German Patent Document DE 102 52 991 A1 for the exact functioning and mechanical design of the rotor actuator device, the text of said patent being included in the disclosure content of the present patent application with regard to the design of the rotary actuator.

Figure 1:
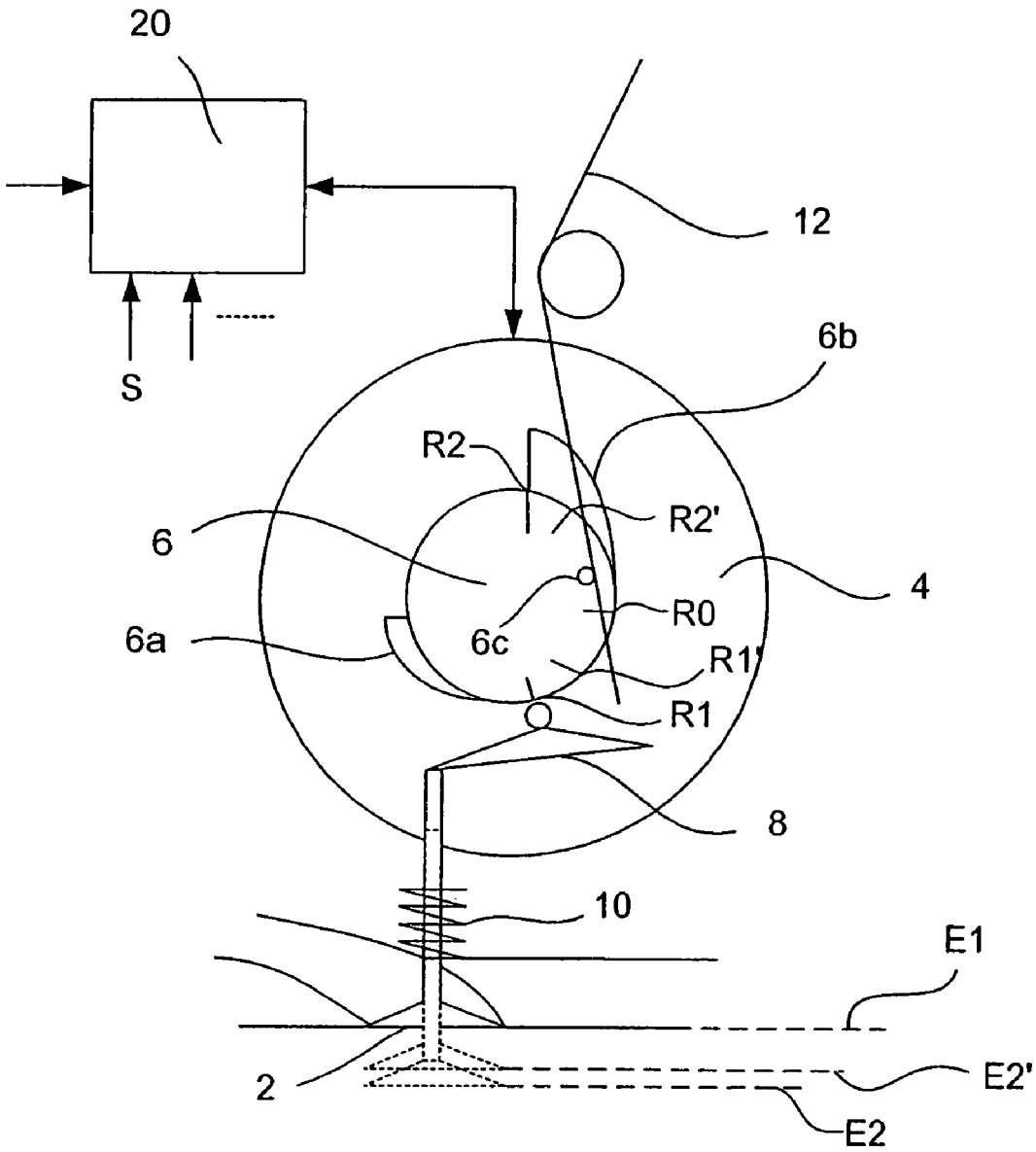
FIG. 1 shows a schematic diagram of a rotary actuator device for the drive of a charge cycle valve of an internal combustion engine (not shown) and FIG. 2 shows in a schematic diagram the torque characteristic of opening and closing springs of a rotary actuator device which acts on a charge cycle valve at the intake end and the resulting lift characteristic of the charge cycle valve so actuated.

To ensure operation of the electric motor 4 with the lowest possible power consumption, said electric motor driving the present charge cycle valve 2 via the camshaft 6, the electric motor 4 is regulated via a control and regulating device 20 (hereinafter referred to as the regulating device) according to a setpoint path which maps the ideal transient characteristic of the spring-mass-spring system—in addition to optimal design of the mutually counteracting springs (closing spring 10, opening spring 12) and the ideal positioning of the fulcrums and hinge points in the geometry of the device itself. In particular this regulation is accomplished by regulating the rotor characteristic of the electric motor 4 which drives the at least one actuator element 6, 6*a*, 6*b*. The ideal distance characteristic of the rotor, which also oscillates as part of the oscillation system, is calculated by analogy with the ideal vibration characteristic of the system as a whole and thus forms the setpoint path for regulating the electric motor 4. For monitoring the actual position of the rotor, there is a distance sensor (not shown) which transmits a sensor signal S to the regulating device 20 or some other control device. The electric motor 4 is controlled by the regulating device 20 such that the at least one charge cycle valve 2 is transferred from a first valve end position E1, which corresponds to the closed valve position, for example, into a second valve end position E2, E2', which corresponds to a partially open valve position (E2': partial lift) or maximally opened (E2: full lift) valve position and vice versa. In regulating the electric motor 4, the rotor and thus the actuator element 6, 6*a*, 6*b* which is operatively connected to the rotor is controlled accordingly in position so that the rotor and/or the actuator element 6, 6*a*, 6*b* will assume a position in the distance range of the cam base circle, e.g., in the distance range between R1 and R1', by analogy with the closed position E1 of the charge cycle valve 2, and by analogy with the second end position E2, E2' [it will assume] a position in the distance range of the cam 6*a*, 6*b*, e.g., in the distance range between R2 and R2'. The system is ideally designed so that the actuator elements 6, 6*a*, 6*b* will travel the distance between two end positions R1 and R2 (full stroke) or R1' and R2' (partial stroke) without any input of additional energy, i.e., without an active drive by the drive device 4 when ambient influences (in particular friction and gas backpressure) are excluded (intentionally disregarding them) and thus [the actuator element] will intervene in a supporting manner only under the ambient influences that occur in practice. This system is preferably designed so that it is in a metastable torque-neutral position at the maximum end positions R1 and R2 of the rotor (vibration end positions at maximum vibration stroke) in which the forces occurring are in an equilibrium and the rotor is held without applying any additional holding force.

In particular, the charge cycle valve 2 in the first metastable and torque-neutral position R1 (shown in FIG. 1) is closed and thus the closing spring 10 is maximally relaxed while retaining a residual prestress while the opening spring 12 is maximally prestressed. The force of the prestressed opening spring 12 is transferred to the camshaft 6 via a stationary supporting element 6*c* thereof and is directed exactly through the midpoint of the camshaft 6 in position R1 and is thus more or less neutralized. The force of the closing spring 10 which also occurs due to the residual prestress is neutralized in the position described because it is also directed at the midpoint of the camshaft 6 via the drag lever 8.

In the second metastable and torque-neutral position R2 (not shown here) the charge cycle valve 2 would be opened with its maximal lift according to the main cam 6*b* and the closing spring 10 arranged around the charge cycle valve 2 would be maximally prestressed, while the opening spring 12 would be maximally relaxed while retaining a residual prestress. The arrangement of the individual components is selected so that the force of the maximally prestressed spring means (now: closing spring 10) and the force of the maximally relaxed spring means (now: opening spring 12) are each directed exactly through the midpoint of the camshaft 6 and are thus be more or less neutralized in this position.

A third stable and torque-neutral position R0, also not shown, occurs when the system assumes a so-called fallen state in which the camshaft 6 assumes a position between the first two torque-neutral positions R1, R2. The system can be brought back out of the fallen position only by means of a high energy consumption, e.g., in that the camshaft 6 is brought back into one of the first two metastable torque-neutral positions R1, R2, by a startup or ramp up of the rotor or the camshaft 6 is ramped up at least to a partial lift at which regular operation of the rotor actuator device is again possible.

By analogy with the three torque-neutral positions R0, R1, R2 described here for operation of the device by means of the main cam 6*b*, there may be additional positions (not shown) for a so-called minimal lift operation in actuation of the second cam 6*a*. For these additional three torque-neutral positions, the same statements as those made for the torque-neutral positions R0, R1 and R2 described above are also applicable here.

With the calculated ideal transient characteristic, the rotor thus oscillates from one end position E1 into the other end position E2, E2' merely on the basis of the forces stored in the energy storage means 10, 12 without any input of additional energy, e.g., by the electric motor 4.

In the case when the rotor in partial-lift operation oscillates from a first end position R1' to a corresponding second end position R2' (in particular at high rotational speeds of the internal combustion engine), the ideal transient characteristic would thus be that of a perpetual motion machine (infinite uniform oscillation).

For the case when the rotor in full-lift operation oscillates from a first end position R1 to a corresponding second end position R2 (in particular at low rotational speeds of the internal combustion engine), it would be held in the end positions R1, R2 in a torque-neutral position and would have to be prompted out of this position by input of a pulse-like thrust energy (engine pulse) to execute the next oscillation into the other end position. Due to the fact that the setpoint paths for full lift and partial lift correspond to the transient characteristic of the rotary actuator device without friction losses and without gas backpressures, this ensures that the regulating device 20 will control the electric motor 4 exclusively to equalize the frictional losses and the gas backpressures that always occur in practice. Since friction losses occur mainly at high rotational speeds of the rotor, the electric motor 4 must deliver the greatest power at high rotational speeds. Since this coincides with the energy-optimal operating point of the electric motor 4, energy-saving operation of same can be ensured by regulation on the basis of idealized setpoint paths of the actuator system to be operated.

Figure 2:
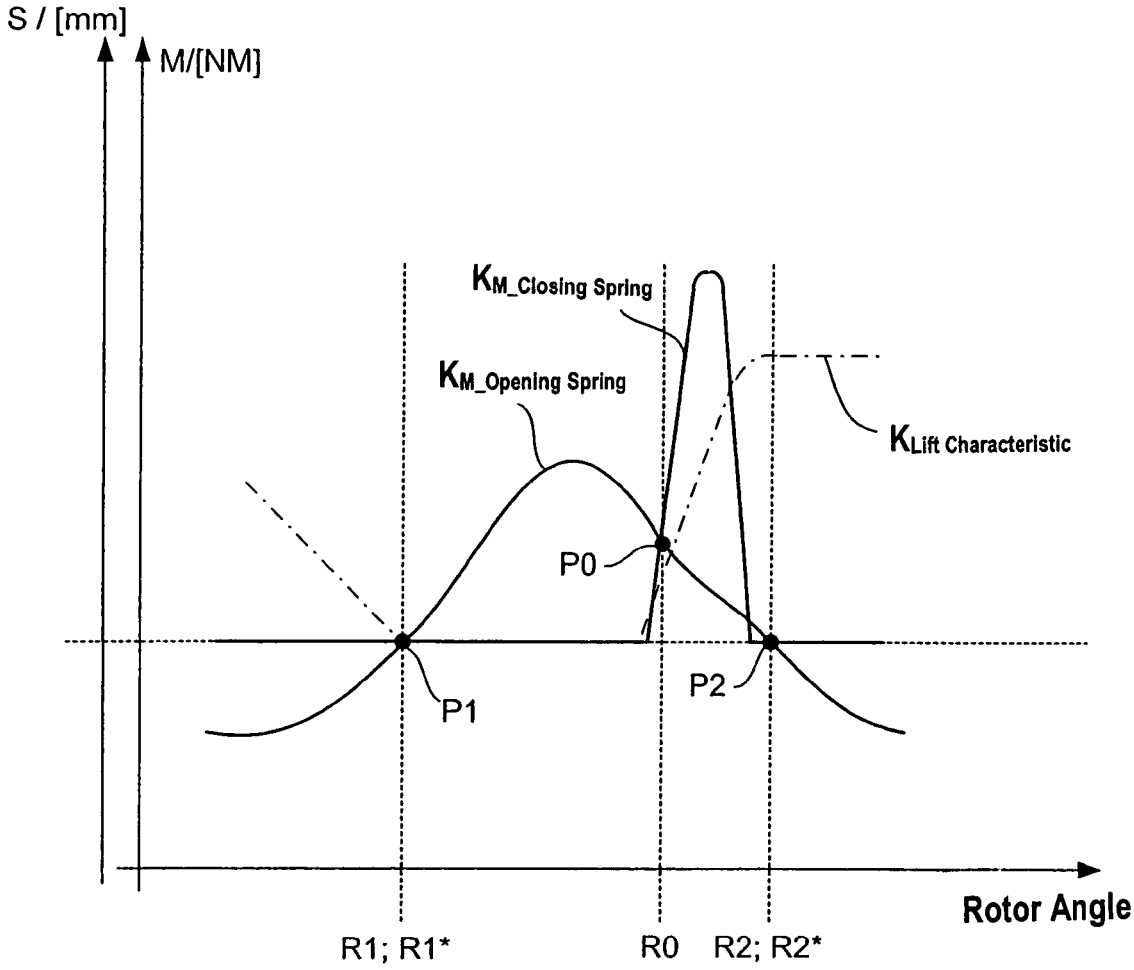

FIG. 2 shows the torque characteristic of the two energy storage means 10, 12 (opening spring and closing spring) of the rotary actuator device which act on a charge cycle valve and the resulting lift characteristic of the actuator charge cycle valve 2 is shown schematically in a diagram. The curve $K_{M_closing\ spring}$ shows the torque curve of the closing spring 10 and curve $K_{M_opening\ spring}$ shows the torque curve of the opening spring 12 during the opening process of a charge cycle valve 2. To illustrate the opening process, the lift characteristic of the charge cycle valve 2 that is controlled is illustrated similarly in the curve $K_{lift\ characteristic}$. In addition, the resulting torque-neutral positions R0, R1, R2 are illustrated at points P0, P1, P2. The first metastable and torque-neutral position R1 of the rotor and/or the actuator element 6, 6*a*, 6*b* during the closing state of the charge cycle valve 2 at full lift is established at point P1 at the point in time when the opening spring curve $K_{M_opening\ spring}$ and the closing spring curve $K_{M_closing\ spring}$ intersect at a positive rise in the curve of the opening spring curve $K_{M_opening\ spring}$. The second metastable and torque-neutral position R2 of the rotor and/or of the actuating element 6, 6*a*, 6*b* during the opening process of the charge cycle valve 2 at full lift is established at point P2 at the point in time when the opening spring curve $K_{M_opening\ spring}$ and the closing spring curve $K_{M_closing\ spring}$ intersect when there is a descending curve characteristic of the opening spring curve $K_{M_opening\ spring}$ and also a descending curve characteristic of the closing spring curve $K_{M_closing\ spring}$. The stable intermediate position R0 described above (also referred to as the fallen or subsiding position) prevails when the opening spring curve $K_{M_opening\ spring}$ and the closing spring curve $K_{M_closing\ spring}$ intersect when the opening spring curve $K_{M_opening\ spring}$ during its descending portion intersects the ascending closing spring curve $K_{M_closing\ spring}$.

The torque characteristics represented here are proportional to the respective resulting restoring torque of the spring forces and thus proportional to the power consumption by the electric motor 4. Starting from a metastable end position R1 or R2 to which the rotor and/or the actuating element 6, 6*a*, 6*b* connected to it in a rotationally fixed manner is converted on the basis of predetermined control time using the measurement signal of the distance sensor, a check is performed in certain intervals to ascertain whether the measurement signal of the distance sensor is correct. In an assumed end position R1, R2, the opening spring and/or the closing spring 12, 10, attempt(s) are made to accelerate the rotor shaft by the stored spring force when the rotor shaft is moved out of the respective end position at full lift. Due to a slow, controlled motion (movement, in particular back and forth) of the rotor near the respective metastable torque-neutral position R1, R2 at full lift, the actual zero-torque position which can be found at the resulting current values for the power consumption of the electric motor 4 may deviate from the zero position defined by a predetermined distance segment as predetermined originally by the distance sensor. By determining the minimum current during the controlled rotor movement that is performed for the purpose of calibration of the distance sensor, the actual torque-neutral position can be determined.

In a second possible embodiment of the invention, the distance sensor is calibrated by the fact that the rotor is transferred by targeted control of the electric motor 4 via the regulating device 20 or some other regulating or control unit into a torque-neutral stable intermediate position R0 which is between the two metastable torque-neutral positions and/or end positions (R1, R2; E1, E2) and the intermediate position R0 thus assumed serves as the zero equalization (and/or as a calibration point) for the calibration of the distance sensor.

However, the distance sensor calibration is suitable exclusively for calibration during (low) rotational speeds of the internal combustion engine to be controlled in which an adequate dwell time of the rotor in the end positions R1, R2 is ensured because the rotor can be moved as described here for the purpose of calibration only during the dwell time of the rotor in the torque-neutral end positions R1, R2. At high rotational speeds, the rotor usually does not reach the torque-neutral end positions, so that such a calibration is impossible here. Movement of the rotor into the intermediate position is not necessary because in contrast with the metastable positions R1, R2, this position is uniquely defined and thus can be verified and/or corrected, if necessary, on the basis of the assumed stable central position R0 of the distance sensor.

Finally, error recognition is provided in a possible refinement of the invention. Error recognition is performed easily by comparing the distances and/or rotor angle ranges between the torque-neutral positions R1, R2, R0 or between a stationary reference point and one or more of the torque-neutral positions with a reference distance and/or a reference angle range and, if a deviation by a predetermined value is found, generating an error signal.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for calibrating a distance sensor of a rotary actuator device for controlling a charge cycle valve of an internal combustion engine, wherein the rotary actuator device includes a controllable electric motor having an actuator element for actuating the charge cycle valve, two energy storage means acting on the charge cycle valve in opposite drive directions, a control unit for controlling the electric motor such that the charge cycle valve is transferred from a first end position in which the actuator element driven by a rotor of the electric motor is in a first metastable torque-neutral position associated with the first end position, to a second end position in which at least one of the actuator element and the rotor is in a second metastable torque-neutral position associated with the second end position, comprising the acts of:

controlling the electric motor starting from one of the first or second metastable torque-neutral positions so that the rotor is moved out of said one of the first or second metastable torque-neutral positions in at least one direction by a distance;

measuring a power consumption by the electric motor during said movement of the rotor out of said one of the first or second metastable torque-neutral positions; and determining a new rotor position for calibration of the distance sensor based on the measured the power consumption by the electric motor.

2. The method as claimed in claim 1, wherein the rotor is moved in both directions from said one of the first or second metastable torque-neutral positions, and the determination of the new rotor position is based on the measured power consumption by the electric motor in both directions.

3. The method as claimed in claim 1, further comprising the acts of:

monitoring at least one of a distance segment and the rotor angle between at least two metastable torque-neutral positions of the rotor or between a stationary reference point relative to the rotor and a metastable torque-neutral position of the rotor; and generating an error signal when there is a deviation by a predetermined value from a predetermined reference value associated with one of the distance segment and the rotor angle.

* * * * *